United States Patent [19]

Matsumura et al.

[11] Patent Number: 4,705,000

[45] Date of Patent: Nov. 10, 1987

[54] APPARATUS AND METHOD FOR CONTROLLING AMOUNT OF FUEL INJECTED INTO ENGINE CYLINDERS

[75] Inventors: Toshimi Matsumura, Aichi; Shinya Sumitani, Anjo; Takahiro Hayakawa, Kariya; Takashi Hasegawa, Tajimi, all of Japan; Shuji Sakakibara, Palos Verdes, Calif.

[73] Assignee: Nippondenso Co., Ltd., Kariya, Japan

[21] Appl. No.: 752,732

[22] Filed: Jul. 8, 1985

[30] Foreign Application Priority Data

Jul. 9, 1984 [JP] Japan ..... 59-141774

[51] Int. Cl.[4] ..... F02M 39/00

[52] U.S. Cl. ..... 123/357; 123/419; 123/494; 73/119 A

[58] Field of Search ..... 123/419, 436, 357-359, 123/494; 73/119 A

[56] References Cited

U.S. PATENT DOCUMENTS

| | | | |
|---|---|---|---|
| 4,357,662 | 11/1982 | Schira | 123/419 |
| 4,418,669 | 12/1983 | Johnson | 123/436 |
| 4,489,690 | 12/1984 | Burkel | 123/419 |
| 4,503,821 | 3/1985 | Miyaki et al. | 123/357 |
| 4,503,824 | 3/1985 | Ninomiya | 123/419 |
| 4,508,075 | 4/1985 | Takao | 123/419 |
| 4,509,477 | 4/1985 | Takao | 123/436 |
| 4,513,721 | 4/1985 | Ina | 123/419 |
| 4,532,905 | 8/1985 | Yokooku | 123/419 |

FOREIGN PATENT DOCUMENTS

| | | | |
|---|---|---|---|
| 58-214627 | 12/1983 | Japan | 123/357 |
| 59-82534 | 5/1984 | Japan | 123/357 |
| 59-141729 | 8/1984 | Japan | 123/357 |

*Primary Examiner*—Carl Stuart Miller

*Attorney, Agent, or Firm*—Cushman, Darby & Cushman

[57] ABSTRACT

In a fuel amount control apparatus arranged to determine the amount of fuel to be fed to respective cylinders so that the scattering in torque generation throughout the cylinders is suppressed, the amount of correction which is either added to or subtracted from a basic fuel amount, is computed such that a sum total of fuel amount correction factors substantially equals zero. To this end the sum total of the correction factors is first computed and is then checked whether an absolute value of the sum total is greater than a predetermined value. When greater, a given amount is either added to or subtracted from correction factors respectively provided for respective cylinders.

4 Claims, 11 Drawing Figures

APPARATUS AND METHOD FOR CONTROLLING AMOUNT OF FUEL INJECTED INTO ENGINE CYLINDERS

BACKGROUND OF THE INVENTION

The present application is related to the U.S. Pat. No. 4,503,821 commonly assigned and patented Mar. 12, 1985.

This invention relates generally to an apparatus and method for controlling an amount of fuel injected into engine cylinders respectively so that torque generated by respective cylinders is uniform throughout the cylinders.

The amount of fuel injected into a multi-cylinder internal combustion engine has been conventionally controlled uniformly throughout all the cylinders in both gasoline engines and diesel engines. According to known electronic fuel injecting systems for gasoline engines, the valve-opening duration of electromagnetic valves respectively provided to individual cylinders is controlled such that the valve opening duration is common to all the cylinders. In known electronically controlled diesel engines, which have been recently put in practical application stage, the position of an injection amount-controlling member, such as a control rack or a spill ring, is controlled where the controlling member is common to all the cylinders.

Although such a control effected uniformly throughout all the cylinders of an engine is simple, there arises a problem of variation or scattering in injecting fuel amount throughout the cylinders. Therefore, in conventional apparatus high manufacturing precision is required when manufacturing various parts, such as injection valves, injection conduits or the like, used in the injection system to reduce such variation throughout the cylinders. Such high manufacturing precision or accuracy necessarily increass the manufacturing cost. Furthermore, even though the precision of used parts have been increased to its limit so that variation throughout cylinders is minimized, the amount of fuel actually injected into engine cylinders has a chance to suffer from variation or scatter throughout cylinders due to secular change or external disturbance, such as a variation in actuating timing of intake and/or exhaust valves or the like.

Such variation in amount of fuel inejected into cylinders of an engine results in irregular rotation of the engine crankshaft. Especially, during idling such irregular rotation is uncomfortable and noisy. Generally speaking, the engine rotational speed during idling is set to a low value in view of suppression of fuel consumption. On the other hand, it is desired, especially for passenger automobiles, that engine rotation during idling is as smooth as possible thereby providing a comfortable environment. Particularly, the above-mentioned irregular rotation during idling is desired to be reduced to achieve stable engine rotation.

To solve this problem, a method was proposed in a Japanese patent provisional publication No. 58-214627 such that the variation in rotational speed around fuel injection in each cylinder is detected first and the amount of fuel to be injected is corrected so that the variation in engine speed becomes uniform, thereby establishing a uniform combustion state in all the cylinders.

However, since this correction control is performed through digital processing using a microcomputer or the like, rounding error due to digit compression is inevitable while there are some other errors caused from variations in the characteristics of various sensors. Such errors occur in each correction of the amount of fuel to be injected for each cylinder, and thus the sum total of the errors of the correction amount for all the cylinders does not necessarily equal zero. This sum total of errors may assume either a positive or negative value, and since each error occurs in each time of correction independent of other error occurring in other correction, it is expected that errors are accumulated as the number of corrections increases in view of stochastic process. As a matter of fact, the sum total of such errors are accumulated in sequence to provide a great absolute value which affects the total amount of fuel supplied to the engine. As a result, engine rotational speed, emission of noxious components, drivability of the automobile equipped with the engine, and the performance of the engine are apt to be undesirably influenced.

SUMMARY OF THE INVENTION

The present invention has been developed in order to remove the above-described drawbacks inherent to the conventional fuel supply system of an internal combustion engine of the type arranged correct the amount of fuel for respective cylinders.

It is, therefore, an object of the present invention to provide new and useful method and apparatus for controlling the amount of fuel injected into engine cylinders so that total amount of fuel to be supplied to the engine is not affected by the correction of the amount of fuel supplied to respective cylinders thereof.

According to a feature of the present invention while the amount of fuel fed to respective cylinders is precisely controlled by detecting torque generated by each combustion in each cylinder, the correction of fuel amount is effected such that a sum total of correction amounts for all the cylinders substantially equals zero. The amount of fuel supplied to the engine is basically determined using engine operational parameters, and then a basic fuel amount is corrected using correction factors provided for respective cylinders. The fuel amount control may be effected by means of an actuator which controls the position of a spill ring of a distributor injection pump.

BRIEF DESCRIPTION OF THE DRAWINGS

The object and features of the present invention will become more readily apparent from the following detailed description of the preferred embodiments taken in conjunction with the accompanying drawings in which.

DETAILED DESCRIPTION OF THE INVENTION

Figure 1:
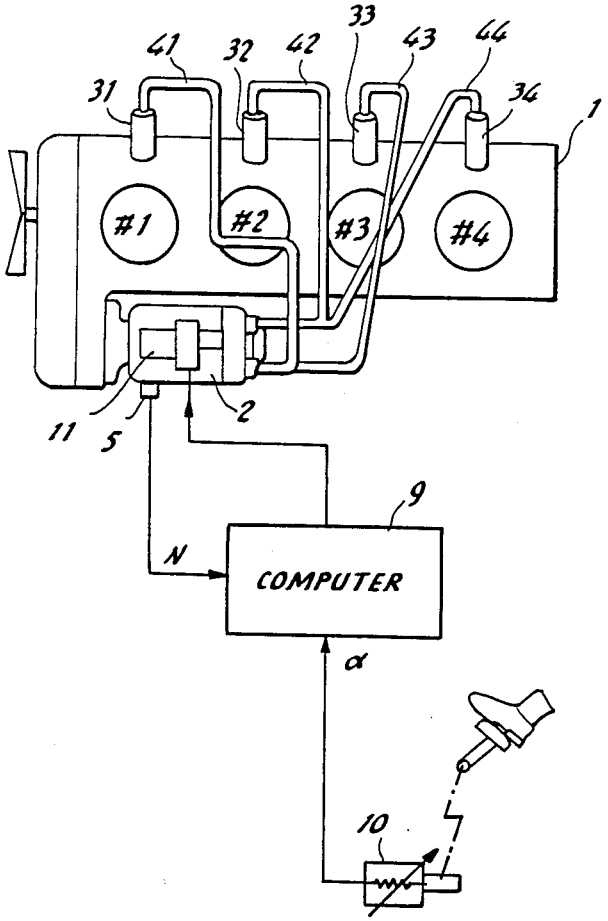
FIG. 1 is a schematic diagram showing an embodiment of the present invention.

Referring now to FIG. 1, a schematic diagram of an embodiment of the present invention is shown. FIG. 1 shows a known 4-cylinder diesel engine 1 arranged to receive fuel from a distributor injection pump 2 (for instance Bosch VE type pump) equipped with an electronic injecting amount control device (so called electronic governer). The injection pump 2 is driven at a speed one half the engine speed via an unshown belt or gear mechanism coupled to the engine crankshaft. Injection nozzles 31 through 34 are provided to individual cylinders of the engine 1 where the injection nozzles 31–34 are respectively coupled by injection steel conduits 41–44 to the distributor injection pump 2. The injection pump 2 is arranged to pressurize fuel led therein from an unshown fuel tank to deliver the same under pressure to respective injection nozzles 31–34 at predetermined timings so that a predetermine amount of fuel is supplied to combustion chambers or auxialiary chambers of respective cylinders of the engine 1.

The injection pump 2 is equipped with a rotational speed sensor 5 which produces an output signal indicative of the rotational speed of a rotary member of the injection pump 2. Since this rotary member rotates in synchronism with the engine rotation, the output signal from the rotational speed sensor 5 also represents the speed of the engine 1. The output signal from the rotational speed sensor 5 is fed to an electronic control unit (ECU) 9 which also receives a signal from a potentiometer 10 associated with an accelerator pedal. The electronic control unit 9 produces an output control signal by using these input signals to control the injection pump 2 so that a desired amount of fuel is injected as will be described in detail hereinlater.

Figure 2:
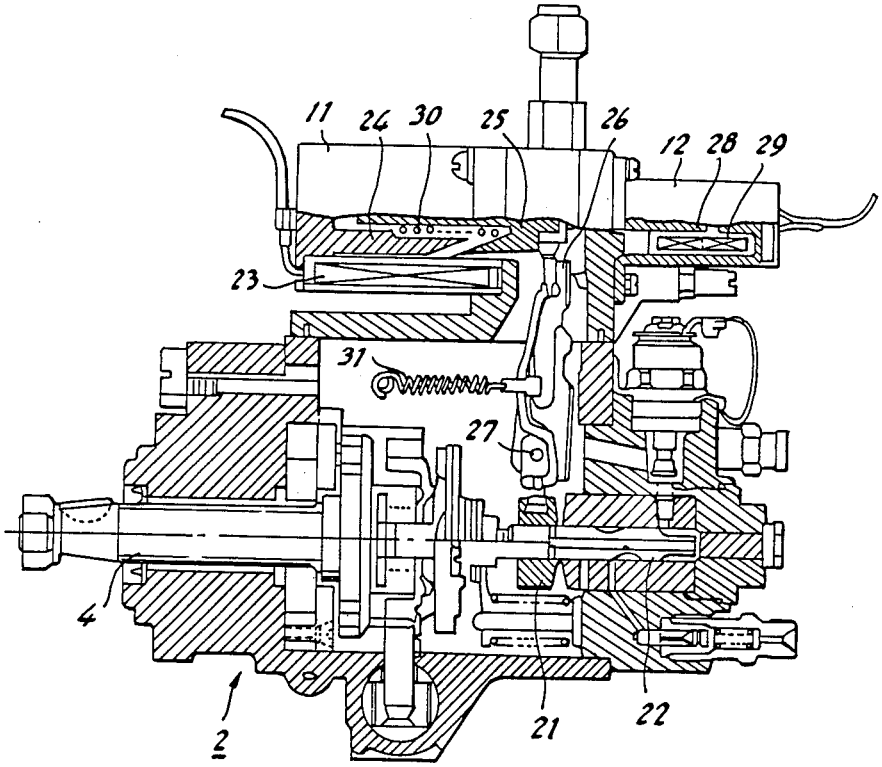
FIG. 2 is a partial cross-sectional view of the distributor injection pump of FIG. 1.
Figure 3:
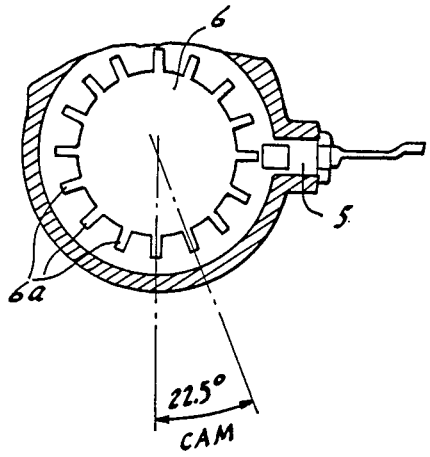
FIG. 3 is a cross-sectional view of the engine speed sensor of FIG. 1.

FIG. 2 shows a cross-sectional view of the injection pump 2 shown in FIG. 1. The injection pump 2 comprises a drive shaft 4 driven by the engine crankshaft. The above-mentioned rotational speed sensor 5 is arranged to detect the rotational speed of the drive shaft 4. Namely, as shown in FIG. 3, the drive shaft 4 is equipped with a disc 6 having 16 projections or teeth 6*a* at its periphery as shown in FIG. 3, and an electromagnetic pickup functioning as the rotational speed sensor 5 is provided to be close to the locus of the projections 6*a*. The projections 6*a* are equiangularly spaced, and therefore, an angle between two consecutive projections with respect to the center of the disc 6 is 22.5 degrees. Since the drive shaft 4, and therefore the disc 6 rotates once per two revolutions of the engine crankshaft, eight projections 6*a* pass the sensor 5 to cause the same to produce eight pulses per one revolution of the engine crankshaft. In other words, the rotational speed sensor 5 produces a pulse output signal each time the engine crankshaft rotates 45 degrees. The pulse output signal from the sensor 5 is referred to as a signal N. This signal N represents not only the rotational speed of the engine 1 but also rotation of the engine crankshaft by a given crank angle, and is fed to a computer which is used as the electronic control unit 9.

The above-mentioned potentiometer 10 produces a voltage signal indicative of the amount of depression of the accelerator pedal, thereby representing the load of the engine 1. Therefore, this potentiometer 10 will be referred to as a load sensor hereinafter. The computer 9 thus determines an amount of fuel to be injected into engine cylinders, which amount is most suitable for engine operating conditions varying time to time. In order to control the fuel injection amount, an injection amount control actuator 11 such as a linear solenoid, included in the injection pump 2 is controlled by the output control signal from the computer 9.

A detailed structure of the distributor injection pump 2 will be described with reference to FIGS. 2 and 3. The injection pump 2 is basically the same as known VE type injection pumps made by Bosch such that the mechanism for fuel intaking, fuel transmission under pressure, and fuel distribution, and injection timing are the same as those in the VE type injection pumps. Therefore description of such known features is omitted. However, the injection pump 2 used in the present invention differs from the known pump in that the axial displacement of a spill ring 21, which is a member for adjusting spilling amount of fuel, is controlled by the above-mentioned actuator 11 using the linear solenoid thereby controlling injection amount by the computer 9.

When the control output signal from the computer 9 is applied to a coil 23 of the actuator 11 having a stator 24 and a movable core 25, a magnetic force proportional to the intensity of the control signal, occurs between the stator 24 and the movable core 23. As a result, the movable core 25 is drawn leftward in the drawing against a biasing force of a spring 30. As the movable core 25 moves leftward, a lever 26 attached to the movable core 25 at its one end is rotated counterclockwise in the drawing around a pivot 27. The other end of the lever 26 is connected to a spill ring 21, and therefore the spill ring 21 is moved to the right in the drawing when the lever rotates counterclockwise. In a VE type injection pump, the larger the rightward movement of the spill ring 21, the later the spill timing, and therefore an instant of termination of fuel injection is retarded. As a result, the amount of injecting fuel is increased. As described in the above, the increase in the current to the actuator 11 results in increase in the amount of injecting fuel, while the decrease in the current results in the decrease in the fuel amount. Accordingly, when the current to the actuator 11 is controlled by the computer 9, it is possible to control the amount of fuel to be injected into engine cylinders.

A position sensor 12 is provided such that it is attached coaxially with the actuator 11 for increasing the control accuracy by correcting the current to the actuator 11. The position sensor 12 comprises a probe 28, which is coaxial and integral with the moving core 25 and made of ferrite or the like, and a position-detecting coil 29.

Fuel injecting amount is normally controlled by the computer 9 by using the above-mentioned signal N and the output signal from the load sensor 10 such that the current to the actuator 11 is controlled so that the position of the movable core 25 thereof is controlled to determine an optimal position of the spill ring 21. However, when the fuel amount is determined by the above normal control, the amount of fuel injected into respective cylinders of the engine 1 is uniformly determined. Therefore, if there is a variation throught valve-opening pressures of respective injection nozzles 31–34, the amount of fuel injected into respective cylinders suffers from scattering accordingly. In order to minimize such variation throughout respective cylinders, a correction processing is effected by way of operation of the computer 9 so that the object of the present invention set forth at the beginning of this specification will be attained.

Figure 4:
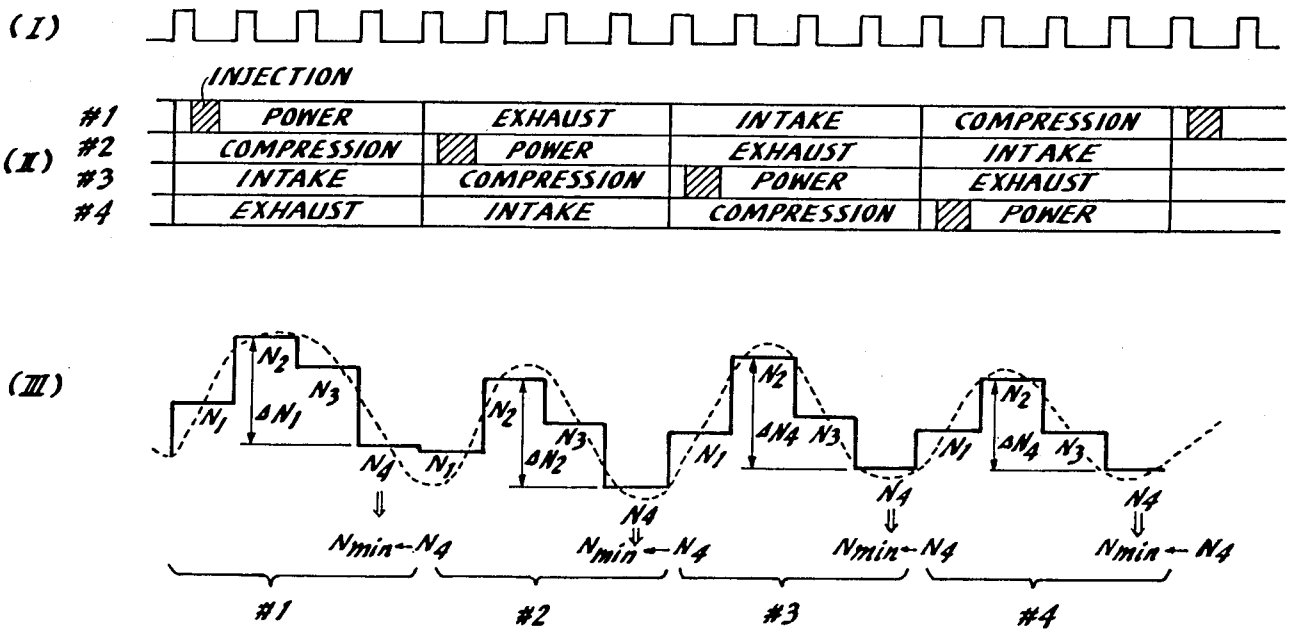
FIGS. 4(I), (II) and (III) are explanatory timing charts showing the operation of the embodiment of FIG. 1.

First of all, the concept of the control for the above-mentioned correction processing will be described with reference to FIG. 4. In FIG. 4, the reference (I) indicates the above-mentioned signal N, while the reference (II) indicates a sequence chart of the operation of the 4-cylinder diesel engine 1. In the sequence chart (II) of FIG. 4, hatched portions show timings of fuel injection to respective cylinders, while references Δ1 to Δ4 indicate cylinder numbers. During idling, to which the present invention is mainly adapted, fuel injection is effected when several degrees of crank angle are passed after the top dead center. The reference (III) in FIG. 4 indicates an output signal obtained by frequency-to-voltage converting the signal N by the computer 9. This signal (III) represents variation in rotation at every 45 degrees of the engine crankshaft rotation. Observing precisely the signal (III) in correspondence with the injection (intake) stroke and power (combustion) stroke within each cylinder, the rotational speed represented by the signal N rapidly increases immediately after combustion, and then lowers as a compression stroke within a next cylinder starts taking place.

Therefore, minute change of the signal N has a period corresponding to one half the engine rotation, while it is known from experiments that a maximum value and a minimum value of the change appears at every 90 degress of the engine crankshaft rotation. Asssuming that the difference between the maximum and minimum values of the change in the rotational speed of each cylinder is expressed in terms of ΔNi (wherein i is a numeral indicative of a number of a cylinder on power stroke), it is known that the value of ΔNi is in correlation with generated torque. Therefore, if the value of ΔNi is made common to all the cylinders, smooth rotation during idling would be resulted. To this end, in the present embodiment a mean value of ΔN1 through ΔN4 is obtained such that $$\Delta N = \sum_{i=1}^{4} \Delta Ni/4,$$

and then the amount of fuel to be injected into individual cylinders is controlled so that each value of ΔNi equals the mean value $\Delta\overline{N}$. In practice, the mean value $\Delta\overline{N}$ is obtained by using inforamtion of newest 4 times of combustions each time ΔNi is dtetcted. Then when ΔNi is greater than $\Delta\overline{N}$, the amount of fuel fed to the cylinder is reduced. On the other hand when ΔNi is smaller than $\Delta\overline{N}$, the amount of fuel fed to the cylinder is increased.

In the embodiment, since the signal N is a pulse train whose each pulse is simply produced at every 45 degrees of the crankshaft rotation, it cannot be determined which cylinder is the one on combustion (power stroke) from the information of the signal N. Although it is possible to determine which cylinder is on combustion if another sensor and an associated disc attached to the cam shaft 4 of the injection pump 2 are provided to detect a particular timing, such as top dead center, of a particular cylinder, the determination of cylinders is effected by using a special program for the computer 9 in the embodiment.

Figure 5:
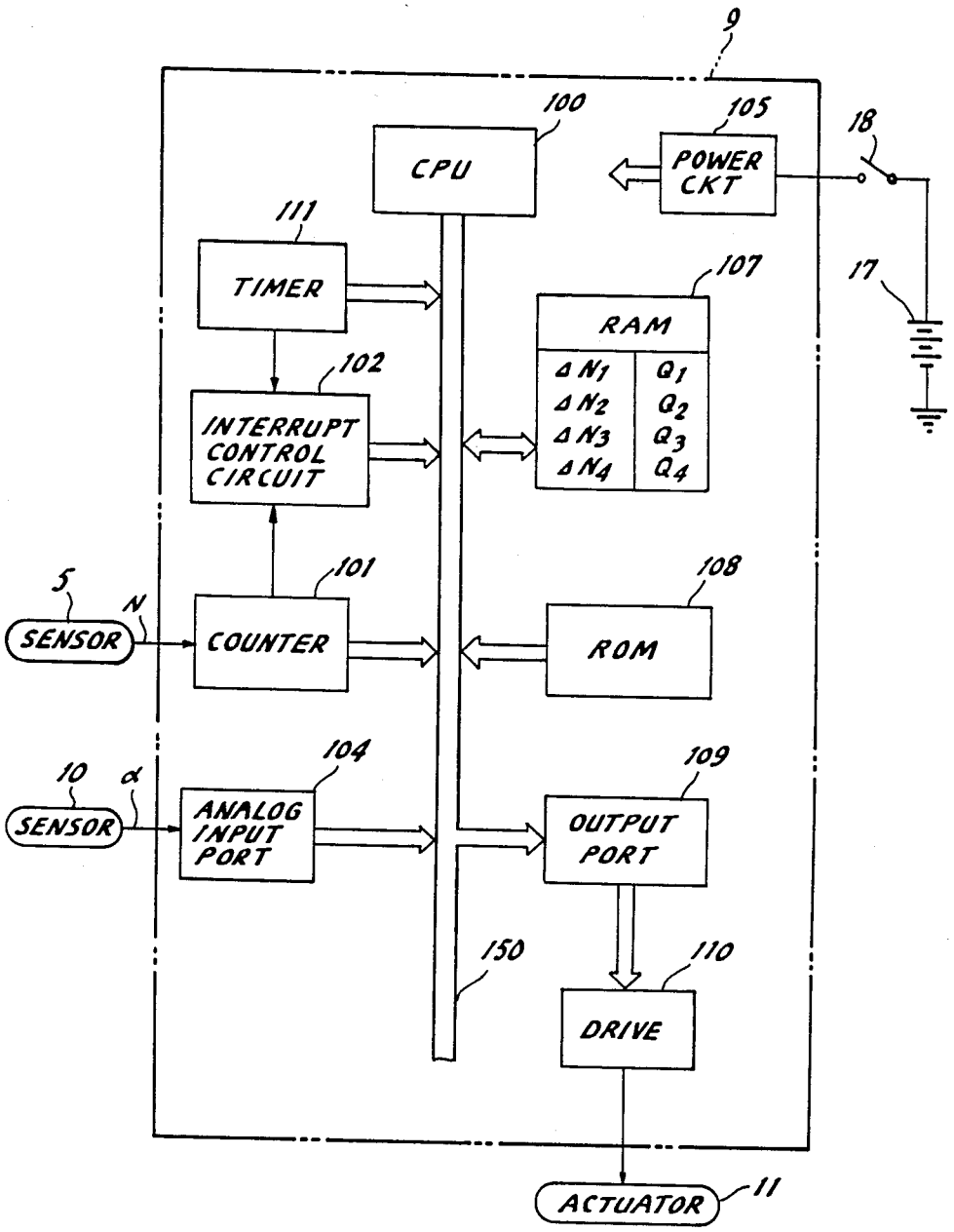
FIG. 5 is a schematic block diagram of the computer of FIG. 1.

Now detailed structure and operation of the embodiment will be described with reference to FIGS. 5, 6, 7A to 7C. FIG. 5 shows a schematic diagram of the computer 9 used as the elctronic control unit and its peripheral circuits. In FIG. 5, the reference 100 is a central processing unit (CPU) which performs operations necessary for the control of the amount of fuel respectively fed to engine cylinders. The reference 101 is a counter responsive to the signal N. Namely, the counter 101 counts the number of pulses included in the signal N sent from an electromagnetic pickup operating as the rotational speed sensor 5, and the count per unit time represent the engine rotational speed. The counter 101 also produces an interruption-control signal in synchronization of the engine rotation, and sends the interruption-control signal to an interruption control circuit 102 at an interval of 45 degrees of the rotational angle of the cam shaft 4.

The interruption control circuit 102 sends an interruption signal via a common bus 150 to the CPU 100 in response to the interruption-control signal.

The reference 104 is an analog input port comprising an analog multiplexer and an analog-to-digital (A/D) converter. The alalog input port 104 is responsive to the load signal indicative of the opening degree of the accelerator pedal, from the engine load sensor 10 for A/D converting the same to prepare digital data which is read into the CPU 100. Output data from these circuits or units 101, 102 and 104 is transmitted via the common bus 150 to the CPU 100. The reference 105 is a power source circuit which is connected via a key switch 18 to a battery 17 mounted on a motor vehicle for the supply of power to the computer 9.

The reference 107 is a random-access memory RAM which is capable of reading and writing data and is temporarily used during the execution of a program. The RAM 107 has an address space for storing various data, such as increment in rotational speed ΔN1 to ΔN4 at every combustion, correction amounts el to e4 used for correcting the current to the actuator 11 each time of combustion, rotational speed data N1 to N4 inputted at every 45° CA (crank angle) and stored till the end of power stroke, and determined cylinder number I.

The reference 108 is a read-only memory in which operational program of the computer 9 and various constants are prestored.

The reference 109 is an output port which sets the amount of the control current, which is fed to the actuator 11, in a drive circuit 110 by using the result of calculation executed by the CPU 100 so that the drive circuit 110 produces the control current by converting the output signal from the output port 109 to an actual driving current fed to the above-mentioned linear solenoid actuator 11.

The reference 111 is a timer which measures lapse of time to send the same to the CPU 100 and sends an interrupt-control signal at an given interval to the interrupt control circuit 102. As described in the above, the counter 101 produces two sorts of interruption-control signals at every top-dead center of respective cylinders and at every 45° cam angle from the top-dead center by counting the number of pulses of the signal N to cause the interruption control circuit 102 to produce the interruption signal. Therefore, the CPU 100 executes an interrupt service routine periodically as will be described hereinlater. In the above, cam angle means the rotational angle of the toothed disc 6 shown in FIG. 3, and it is to be noted that 45° cam angle equal 90° CA. (crank angle).

Figure 6:
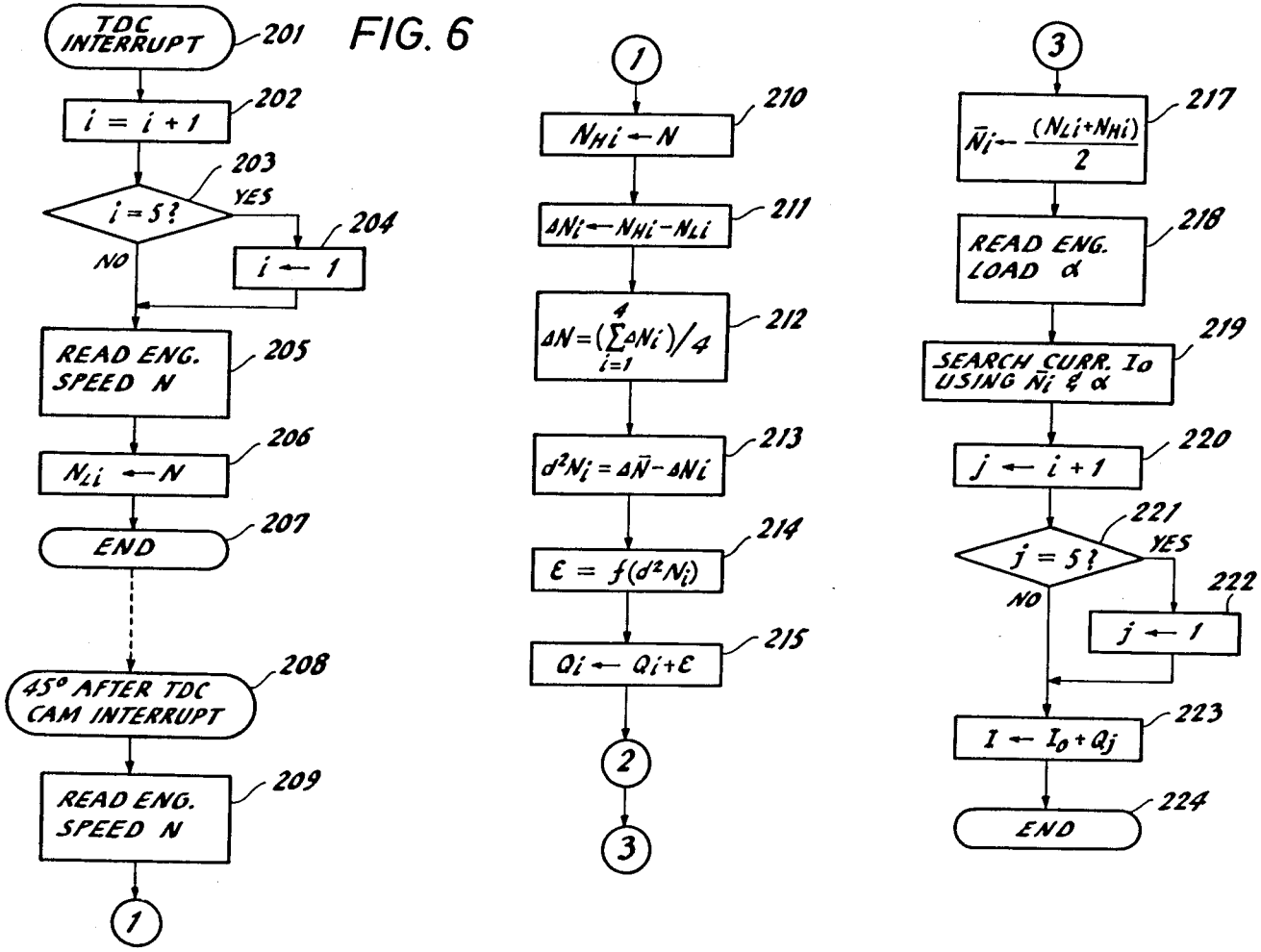
FIG. 6 is a flowchart showing a program provided for the computer of FIG. 5.
Figure 7:
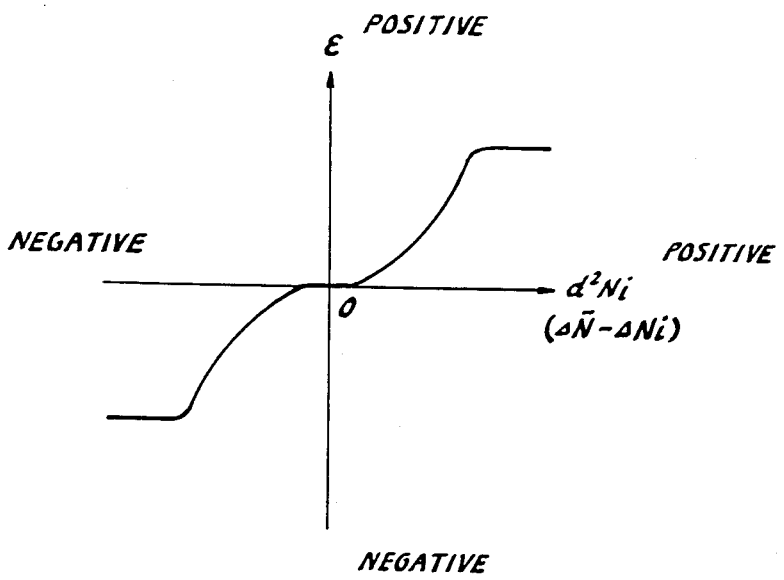
FIG. 7 is a graph showing the relationship between variables used in the program of FIG. 6.

The operation of the computer 9 for the control of fuel injection will be described hereinafter with reference to flowcharts of FIGS. 6, 8 and 9. FIG. 6 shows an interrupt service routine which is referred to as top-dead center interrupt routine. When the top-dead center interruption occurs in the step 201, then a variable "i" used for identifying a cylinder is incremented by one, i.e. $i=i+1$ in a step 202. In a following step 203, it is checked whether the value of the cylinder-identifying variable, which has been incremented by one, is 5 or not. If "i"=5, the value of "i" is reset to 1 in a step 204. Since the value of "i" represents the cylinder number and since the present embodiment is directed to a four-cylinder engine, "i" is reset to 5 when it exceeds 4. On the other hand, if "i" is not equal to 5, a step 205 is executed. It is to be noted that if "i"=4, processing is peformed in connection with the fourth cylinder paying attention to the variation in the rotational speed. Therefore, the cylinder-identifying variable "i" is incremented by one so that "i"=4+1=5 in a subsequent cycle, and therefore "i" is reset to 1 for processing in connection with the first cylinder again.

In the step 205, an instantaneous rotational speed is read using the count of the counter 101 and the count of the timer 111, and in a following step 206, this rotational speed data N is stored as a rotational speed NLl at a time before present injection. Then the top-dead center interrupt service routine is terminated at a step 207.

The CPU 100 may execute some other processings until a subsequent interruption occurs. When a second interruption instruction of every 45° cam angle after the top-dead center occurs, a second interrupt service routine of steps 208 et seq. is started. In a step 209, the present engine rotational speed N is read from the counter 101 and the timer 111, and then the detected engine speed N is stored as a rotational speed NHi at a time after fuel injection in a step 210. In a following step 211, the former engine speed data NLl, which has been stored in the top-dead center interruption, is subtracted from this new engine speed data NHi, and this difference NHi−NLi is written in the RAM 107 as an increment ΔNi of engine speed. In other words, an old increment ΔNi of engine speed is updated or rewritten by the difference NHi−NLi.

In a following step 212, a mean value $\Delta\overline{N}$ of ΔN1 through ΔN4 stored in the RAM 107 is computed. In this way a latest average increment $\Delta\overline{N}$ of engine speed is periodically updated as the step 212 is executed. Suppose the present processing is directed to the fourth cylinder (i.e. i=4), only ΔN4 is renewed from an old value of a former cycle to a newly obtained value, and then the computation of $\Delta\overline{N}$ is executed. Therefore, resulted $\Delta\overline{N}$ is based on the latest four values of ΔNi.

Then in a step 213, a difference $d^2Ni=(\Delta N-\Delta Ni)$ between the above-mentioned $\Delta\overline{N}$ and a present increment ΔNi of engine speed is computed. Using this difference, a scattering-correction integration factor $\epsilon=f(d^2Ni)$ is obtained. This scattering-correction integration factor is a variable used for further correcting a correction factors Qi stored in the RAM 107 where the correction factors Qi are used to correct control current values for respective injections. This correction integration factor ε is a function of the difference $d^2Ni$ as indicated in the above, and the relationship between them is illustrated by a graph of FIG. 7. More specifically, the correction integration factor ε may assume both positive and negative values and generally increases as the difference $d^2Ni$ increases. The value of the correction integration factor may be searched, using the value of the difference $d^2Ni$, from a map of data thereof prestored in the ROM 108. Then in a following step 215, the correction integration factor derived in this way is added to each Qi stored in the RAM 108. As a result, the value of Qi is either incremented or decremented depending on the sign of the correction integration factor ε. It is assumed that the value of Qi is initialized so that Q1=Q2=Q3=Q4=0 by an unshown initialization step at the beginning of operation.

In a step 217, the above-mentioned NLi and NHi are averaged to obtain a present absolute engine speed Ni, and in a following step 218 a present engine load signal α is read from the analog input port 104. In a step 219, a basic control current Io to be fed to the actuator 11 corresponding to a basic amount of fuel to be injected into a cylinder after the present processing, is searched from a two-dimentional map provided in the ROM 108 in advance. This search is effected using the average engine speed Ni and the engine load α represented by the stroke of the accelerator pedal. The basic control current Io is corrected on the basis of the value of the integration of the engine speed at each combustion, and the correction factor Qi for a cylinder is renewed using ΔNi obtained in connection with this cylinder in which fuel has already been injected. Accordingly, the actuator control current I to be outputted at the end of the present processing should be produced by reflecting a correction factor obtained in connection with a cycle to which fuel injection is to be made subsequently. Therefore, the correction factor Qi renewed and stored three cylcles before is used rather than a correction factor Qi just obtained in the present processing.

To this end, the cylinder identifying number "i" is incremented by 1 to obtain a correction factor cylinder corresponding number "j" in a step 220. Then it is checked whether "j" equals 5 or not in a step 221. If "j" is not equal to 5, a correction factor Qj corresponding to the value of "j" is read out from the RAM 107 to be added to the basic actuator control current Io in a step 223. As a result, the actuator control current I is produced which is set in the output port 109 for displacing the actuator 11 in preparation of subsequent injection. On the contrary, if "j"=5 in the step 221, "j" is reset to 1 in a step 222 prior to advancing to the step 23. With this operation therefore, assuming that the processing is effected with i=3, i.e. in connection with the third cylinder, as far as the step 219, since a cylinder where fuel injection takes place is the fourth cylinder, data Q4 which has been renewed three cycles before is now read out from the RAM 107. Similarly, if the processing as far as the step 219 has been executed with "i"=4, i.e. in connetion with the fourth cylinder, then "j"=4+1=5 and therefore, "j" is reset as "j"=1 so that the actuator control current I for fuel injection into the first cylinder, to which injection takes place subsequently, is corrected using Ql.

Repeating the above processings then the amount of fuel to be injected is gradually decreased in connection with a cylinder where the increment of the engine speed at each combustion is greater than an average, while the amount of fuel to be injected is gradually increased in connection with a cylinder where the increment of the engine speed at each combustion is smaller than the average. With this operation, the engine is put in an operating state of showing an increment of engine speed which is uniform throughout all the cylinders, where equal rotational torque is generated by respective cylinders.

With only the above control, however, a sum total $$S = \sum_{i=1}^{4} Qi$$

of the injection correction factors Qi for all the cylinders does not become zero usually because of various reasons such as an error of an LSB on reading the N signal in the step 205 and 209, rounding error due to digit compression on computation of ΔN in the step 212, and by the fact that the correction integration factor $\epsilon$ is not a linear function of $d^2Ni$. Furthermore, this sum total S is accumulated as time goes so that there is a tendency of continuous increase or decrease. The increase of the absolute value of the sum total S affects the overall amount of fuel injected into engine causing undesirable problems. This drawback can be removed by a processing of an interrrupt routine of FIG. 8.

Figure 8:
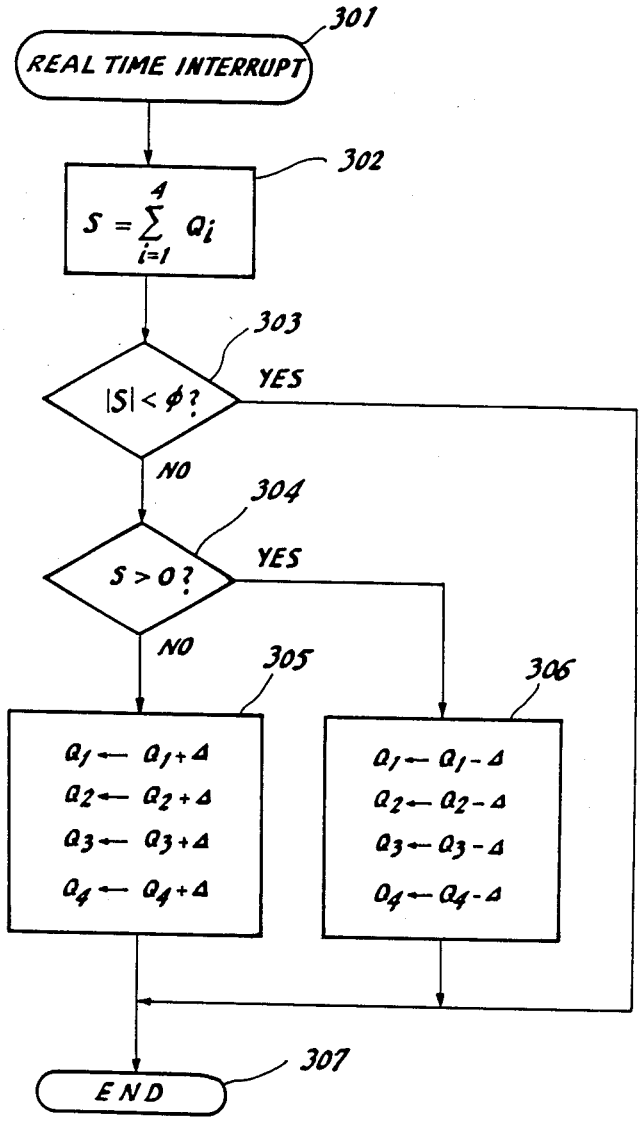
FIG. 8 is a flowchart showing a program provided for the computer of FIG. 5 for making the sum total of injection amount correction factors zero.

Hence, reference is now made to FIG. 8 showing another interrupt service routine which is started at a given time interval. This routine is therefore called a real time interrupt routine. When real time interrupt signal is received at the given interval in a step 301, the routine is started for executing a processing which is referred to as neutralization correction.

In a step 302, the above-mentioned sum total $S=\Sigma Qi$ of the fuel injection amount correction factors Qi for respective cylinders, which correction factors are stored in the RAM 107, is computed. Then in a step 303, it is checked whether an absolute value $|S|$ of the sum total S is greater than a predetermined value $\phi$ corresponding to a value, for instance 0.5 $mm^3$/st, which gives possible undesirable influences to the engine 1. When the absolute value $|S|$ is greater than the predetermined value $\phi$, a following step 304 is executed to correct the injection amount correction factors Qi.

In steps 304, 305 and 306, a given amount of ccorection Δ is added to or subtracted from the injection amount correction factors Qi of all the cylinders in accordance with the sign of the above-mentioned sum total S. As a result, correction is made so that the absolute value $|S|$ of the sum total of the injection amount correction factors Qi decreases.

As the above processing is repeated at an interval, the absolute value $|S|$ is suppressed to be within the predetermined value $\phi$.

In the above-described embodiment, although real time interruption is arranged to occur at the step 301, the routine of the steps 302 et seq. may be executed at an interval without interrupt routine with the timer 111 being used as a watch dog timer watching lapse of time all the time.

According to an experiment by the present inventors, satisfactory results have been obtained when real time interruption of every 10 msec is used for the step 301, while the predetermined value $\phi$ in the step 303 is set to 0.2 $mm^3$/st, and the predetermined amount of correction Δ in the steps 305 and 306 is set to a value corresponding to 0.05 $mm^3$/st.

If the time interval of real time interruption is too long, the neutralization correction speed (product of the correction amount Δ and the number of neutralization corrections per unit time) cannot catch up with learning correction speed (product of the above-mentioned $\epsilon$ and the number of combustions per unit time) of the injection correction factors Qi for respective cylinders. As a result, sufficient result of neutralization correction cannot be obtained at the beginning of correcting operation, at transient periods and during the learning correction of Qi, causing the sum total S of the injection amount correction factors Qi to be an undesirably large value temporarily with which the above-described various problems are resulted.

Furthermore, in the case that the correction amount Δ per each neutralization correction is too large, temporary vibrations of the engine are apt to occur due to noncontinuous variation in fuel amount caused from such neutralization correction. For this reason therefore, the speed of neutralization correction is desired to be substantially equal to or slightly higher than the speed of learning correction of injection amount correction factors Qi.

Since the above-described neutralization correction results in simultaneous change of the injection amount correction factors Qi of the respective cylinders by a given amount, the sum total S is corrected while the amount of correction for reducing scattering throughout respective cylinders remain as a difference (Qj−Qk) of the injection amount correction factors Qi of the respective cylinders. As a result, no particular condition is needed for performing the neutralization correction, and therefore, continuous operation of the neutralization correction does not give any undesirable influences to the engine 1.

In the case of providing upper and lower limits to injection amount correction factors Qi of the respective cylinders, since the sum total S of the injection amount correction factors Qi is kept around zero through the neutralization correction, there is an advantage that the dynamic range of injection amount correction is kept constant.

While the correction is made by a predetermined amount Δ, in the above-described first embodiment, periodically at a given interval, the neutralization correction may be effected each time the fuel injection amount is computed for each cylinder. Hence, another or second embodiment of the present invention will be described with reference to a flowchart of FIG. 9.

Figure 9:
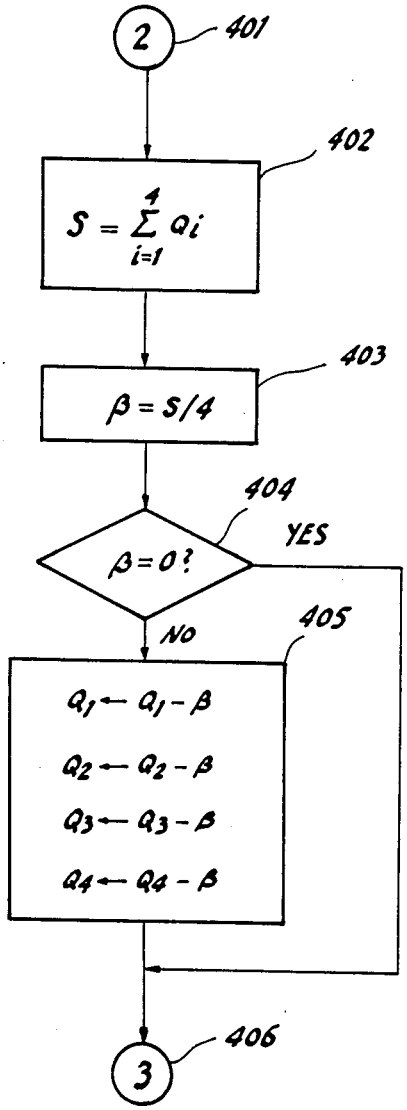
FIG. 9 is a flowchart showing an additional program which may be combined with the flowchart of FIG. 6 to provide another embodiment.

In the second embodiment, neutralization correction shown in FIG. 9 is performed after the step 215 of the flowchart shown in FIG. 6, and the operational flow returns to the routine of FIG. 6 after completion of the processing of the neutralization correction of FIG. 9 to execute steps 217 et seq. where the value of the current to the injection amount control actuator 11 is determined. In other words, the flowchart of FIG. 9 is interposed between ② and ③ of the flowchart of FIG. 6 to provide the second embodiment.

Referring now to FIG. 9, in a step 402, the sum total $$S = \sum_{i=1}^{4} Qi$$

of the injection amount correction factors Qi stored in the RAM 107 is computed. Then in a following step 403, a deviation $\beta=S/4$ per cylinder, which is obtained by dividing the sum total S by the number of the cylinders, is computed. In the following steps 404 and 405, the above-mentioned deviation $\beta$ is substracted from the injection amount correction factors Qi of all the cylinders to provide new injection amount correction factors Qi which are rewritten in the RAM 107. The values of the injection amount correction factors Qi are either incremented or decremented depending on the positive or negative sign of the deviation $\beta$.

The neutralization correction is completed by the above-described steps and then the step 217 of FIG. 6 is executed in the same manner as in the first embodiment. As a result, the sum total S of the injection amount correction factors Qi is always zero so that the engine cylinders produce identical and stable rotational torque causing the engine 1 to operate stably and smoothly.

Although the above embodiments have been described in connection with a four-cylinder diesel engine where the amount of fuel to be injected into each cylinder is corrected with engine speed being detected, the present invention may be adapted to any multi-cylinder internal combustion engines as long as the amount of fuel to be injected into respective cylinders is separately controlled. For instance, the present invention may be adapted to a fuel injection control apparatus arranged to detect vibration acceleration of respective cylinders before and after combustion.

The present invention is advantageous since it can be readily applied to conventional fuel control apparatus in which fuel amount is controlled to supply an identical amount of fuel to all the cylinders. The present invention provides individual fuel control to respective cylinders without giving undesirable influences while the total amount of fuel is the same as in the conventional systems. Therefore, various data (for instance, the above-mentioned two-dimentional map of Io used in the step 219 with the parameter of Ni and $\Delta$) of conventional engines which have been obtained through a number of experiments can be used as they are so as to provide suitable control.

From the foregoing it will be understood that the present invention corrects the amount of fuel to be injected to respective cylinders so as to provide uniform torque generation throughout the cylinders, and the sum total of correction values equals substantially zero. As a result, uncomfortable irregular vibrations of engines are effectively prevented and stable rotation is ensured for a long period of time thereby smooth control is also provided.

The above-described embodiments are just examples of the present invention, and therefore, it will be apparent for those skilled in the art that many modifications and variations may be made without departing from the spirit of the present invention.

What is claimed is:

1. Apparatus for controlling the amount of fuel injected into a multi-cylinder internal combustion engine, comprising:

(a) means for detecting rotational speed of said engine at least two different angles of a crankshaft of said engine for producing two engine speed data NHi and NLi for each of the cylinders of said engine wherein "i" is a positive integer indicating cylinder number;

(b) means for detecting operational parameters of said engine including engine load;

(c) computing means;

for obtaining a difference $\Delta Ni = NHi - NLi$ between said two engine speed data measured for each of said cylinders;

for obtaining an average difference $\Delta N$ using a plurality of difference values $\Delta Ni$ computed for the respective cylinders;

for obtaining a further difference $d^2Ni$ by substracting said differences $\Delta Ni$ from said average difference $\Delta N$ respectively for all the cylinders;

for obtaining a correction integration factor $\epsilon$ using said further difference $d^2Ni$ respectively for all the cylinders;

for correcting a correction factor Qi, which is provided for each cylinder for respectively correcting the amount of fuel to be supplied to the cylinders, using said correction integration factor $\epsilon$ respectively for all the cylinders;

for obtaining a sum total $S = \Sigma$ Qi of all of said correction factors Qi;

for checking whether said sum total S has a particular relationship with a predetermined value;

for incrementing or decrementing each of said correction factors Qi depending on the relationship of said sum total S and said predetermined value;

for obtaining basic fuel amount Io using engine speed data and engine load data;

for correcting said basic fuel amount Io by said correction factors Qi provided respectively for all the cylinders; and for producing a control signal using corrected basic fuel amount; and (d) means for controlling the amount of fuel injected into the engine cylinders in accordance with said control signal.

2. Apparatus as claimed in claim 1, wherein said means for detecting comprises:

(a) a toothed disc arranged to rotate in synchronization with the engine crankshaft; and (b) an electromagnetic pickup responsive to the passage of each tooth of said disc.

3. Apparatus as claimed in claim 1, wherein said means for controlling comprises a distributor injection pump having a spill ring arranged to be moved by an electromagnetic actuator responsive to said control signal.

4. A method for controlling the amount of fuel injected into a multi-cylinder internal combustion engine, comprising the steps of:

detecting a rotational speed of said engine upon at least two different angles of a crankshaft of said engine to producing two engine speed data NHi and NLi for each of the cylinders of said engine, wherein "i" is a positive integer indicating cylinder number;

detecting operational parameters of said engine, including engine load;

obtaining a difference $\Delta Ni = NHi - NLi$ between said two engine speed data produced in said detecting step for each of said cylinders;

obtaining an average difference $\Delta N$ using a plurality of said difference values $\Delta Ni$ computed for the respective cylinders;

obtaining a further difference $d^2Ni$ by subtracting said differences $\Delta Ni$ from said average difference $\Delta N$ respectively for all the cylinders;

obtaining a correction integration factor $\epsilon$ using said further difference $d^2Ni$ respectively for all the cylinders;

correcting a correction factor Qi, which is provided for each cylinder for respectively correcting the amount of fuel to be supplied to the cylinders, using said correction integration factor $\epsilon$ respectively for all the cylinders;

obtaining a sum total $S=\Sigma Qi$ of all of said correction factors Qi;

checking whether said sum total S has a particular relationship with a predetermined value;

performing one of incrementing and decrementing of each of said correction factors Qi depending on the relationship of said sum total of S and said predetermined value;

obtaining a basic fuel amount Io using engine speed data and engine load data;

correcting said basic fuel amount Io using said correction factors Qi provided respectively for all the cylinders;

producing a control signal using said corrected basic fuel amount; and controlling the amount of fuel injected into the engine cylinders in accordance with said control signal.

* * * * *